US008123157B2

(12) United States Patent
Valls Roca et al.

(10) Patent No.: US 8,123,157 B2
(45) Date of Patent: Feb. 28, 2012

(54) PROCESS FOR PRODUCTION OF A BOBBIN TUBE FOR YARN, DEVICE FOR EMBODIMENT OF SUCH PROCESS, BOBBIN TUBE OBTAINED AND MODE OF UTILISATION OF SAID BOBBIN TUBE

(75) Inventors: Ramon Valls Roca, Barcelona (ES); Pere Cardona Guell, Sant Feliu de Llobregat (ES)

(73) Assignee: Klinsan BCN S.L., Barcelona, Spain ( * ) Notice: Subject to any disclaimer, the term of this patent is extended or adjusted under 35 U.S.C. 154(b) by 1004 days.

(21) Appl. No.: 11/556,078

(22) Filed: Nov. 2, 2006

(65) Prior Publication Data

US 2007/0057111 A1 Mar. 15, 2007

Related U.S. Application Data

(62) Division of application No. 11/456,805, filed on Jul. 11, 2006, now Pat. No. 7,722,518, which is a division of application No. 10/480,386, filed as application No. PCT/ES02/00282 on Jun. 10, 2002, now Pat. No. 7,160,236.

(30) Foreign Application Priority Data

Jun. 15, 2001 (ES) ..... 200101552 U

(51) Int. Cl.
*B65H 75/18* (2006.01)

(52) U.S. Cl. ..... 242/605; 242/118.3

(58) Field of Classification Search ..... 242/118.1, 242/118.11, 118.2, 600, 605, 118, 118.3, 242/118.32

See application file for complete search history.

(56) References Cited

U.S. PATENT DOCUMENTS

| | | | | |
|---|---|---|---|---|
| 1,983,361 | A * | 12/1934 | Gazette | 264/299 |
| 3,990,649 | A | 11/1976 | Adams | |
| 4,949,913 | A * | 8/1990 | Fernandez | 242/118.3 |
| 5,056,733 | A | 10/1991 | Sefars et al. | |
| 6,394,386 | B1 * | 5/2002 | Lo | 242/610.3 |
| 2003/0034413 | A1 * | 2/2003 | Pederson et al. | 242/118.31 |

FOREIGN PATENT DOCUMENTS

| | | | |
|---|---|---|---|
| DE | 29708239 | U1 * | 7/1997 |
| EP | 1060720 | | 12/2000 |
| GB | 2314827 | A | 1/1998 |
| GB | 2344337 | A | 6/2000 |
| JP | 2001-031055 | A | 2/2001 |

OTHER PUBLICATIONS

Translation of DE 29708239 U1.*

* cited by examiner

*Primary Examiner* — William E Dondero
(74) *Attorney, Agent, or Firm* — Sughrue Mion, PLLC

(57) ABSTRACT

A cardboard tube, with respect to a narrow marginal end area of the same provided with a hollow interior roll, is applied against a rotatory die which has a concave surface suitable for forming an entrant perimetric step by means of constriction of the narrow marginal area. The diameter of the riser thereof is equal to the interior diameter of the cardboard tube. At the same time, against the interior hollow roll is applied a force of enough intensity to flatten the cavity of the interior hollow roll and apply the wall thereof against the interior face of the wall of the cantilevered end of the cardboard tube formed by the action of its rotatory die.

4 Claims, 5 Drawing Sheets

PROCESS FOR PRODUCTION OF A BOBBIN TUBE FOR YARN, DEVICE FOR EMBODIMENT OF SUCH PROCESS, BOBBIN TUBE OBTAINED AND MODE OF UTILISATION OF SAID BOBBIN TUBE

This is a divisional of application Ser. No. 11/456,805 filed Jul. 11, 2006, which is a divisional of application Ser. No. 10/480,386 filed Dec. 11, 2003, which is a 371 of a PCT/ES 0200282 filed Jun. 10, 2002, which is an application of U200101552 filed Jun. 15, 2001. The entire disclosure(s) of the prior application(s), application number(s) Ser. No. 10/430,386 is considered part of the disclosure of the accompanying Divisional application and is hereby incorporated by reference.

FIELD OF THE INVENTION

This invention relates to a process for production of a yarn bobbin tube, a device for embodiment of the process, the bobbin tube obtained and the mode of utilisation of such in transport and storage.

Such yarn bobbin tubes consist of cardboard cylindrical tubes having characteristics suitable for serving as support for a yarn wound onto such by means of crossed winding or other method, in order to allow the storage and transport of the yarn and guarantee its integrity between a spinning mill and the preparation section of a weaving mill, or between the former and other finishing, dying, texturing industrial establishments.

In most cases, this type of cardboard cylindrical tube has a beading formed interiorly at one of its ends, which forms a marked hollow perimetric roll; in other cases and less frequently the cardboard tubes either lack a roll, or have a roll at both ends The reels of yarn wound on said cardboard tubes, which in the present specification will be referred to as bobbins, whether the yarn is natural, artificial or synthetic, are stored and transported either freely piled or piled in the interior of cardboard boxes, containers or on pallets wound in plastic shrink film.

In either case, but especially as concerns pallet transport and storage, layers of yarn reels are formed which are separated by thick sheets of cardboard, said sheets having apertures for introduction into the same of the ends of the bobbin tubes which allow ordered positioning of the reels in lines and rows or staggered.

In these conditions, such as illustrated in FIG. 16, the reels of yarn bear directly by means of their bases on the separators constituted by said thick sheets of cardboard, on account of which the yarn reels of the lower layer must support the corresponding weight of all the upper reels, whilst the cardboard bobbin tubes cannot assist in supporting said weight, given that the bobbin tubes arranged in the same vertical do not enter into contact with each other, as can be observed in the figure above mentioned.

This system of storage by piling has another serious drawback which is especially significant as concerns transport of the bobbins by box or pallet, since the thick cardboard separator sheets represent a high percentage of the weight and volume of the consignment, giving rise to increased package and transport costs.

So as to overcome such drawback, the solution adopted is that the very cardboard tubes for the bobbins of yarn should themselves support the entire weight of the yarn reels, by means of stable piling with coupling, insertion or fitting together of the bobbins of one layer with the bobbins of the other layers arranged in one and the same vertical.

For the purposes of said solution it is necessary to arrange the bobbin tubes so that they can be coupled together in linear succession by means of fitting together of a given end of a bobbin tube in the opposite end of a second analogous bobbin tube, the solution adopted to enable such has been to constrain one end of the tube so that the unconstrained end of a second analogous tube can couple with said constrained end by means of a slight fitting together.

Nevertheless, such an arrangement of the bobbin tubes that allows piling with fitting together of the same, and which is well known in tubes and cones produced in plastic or metallic materials or wood, proves to be far more difficult when one tries to apply it to cardboard tubes, which confirms the fact that until now such tubes cannot be found commercially, although a need for such is obvious.

The problem arises when the ratio between the interior diameter of the rolled end and the external diameter of the tube is too small.

For years this ratio was considered to be obligatorily: 1

$$\frac{Dext - Dint}{6} \geq e$$

in which e is the thickness of the tube.

When this ratio was not complied with different means were used, all of which are known and whose purpose was the compression of the cardboard to below the above-mentioned ratio. By way of generally known methods the following may be cited: irregular profiles in the base or the sides of the mould or die; application of temperature in the mould; insertion of die stamps at the base of the mould; mechanizing of steps; male die working on female die and insertion of die stamps in the centre of the mould.

The general problem with these methods continues to be the fact that the ratio can be slightly improved but only in a certain amount, whilst the highly energetic actions performed on the cardboard have negative implications for the strength of the cardboard at the part which receives the treatment. One of the problems associated with these methods takes the form of a delamination or exfoliation of the layers of the cardboard, which results in a reduction of the tube's strength. To compensate this problem it is very often necessary to resort to a higher paper quality since it offers a better resistance to delamination.

The problematic confronted in relation to the possibility of manufacturing a tube capable of being fitted together, tends to develop a work method that overcomes the limitations of the present systems.

The technical challenge is an important one as proved by the opinions of the technicians who until the present time thought that manufacture of a tube having these characteristics was impossible, basing said opinion on the observable fact that forcing a reduction of diameter in a cardboard tube was practically impossible due to the delamination problems brought about by conventional methods. To this problem had to be added the difficulty of achieving rolled ends in paper with ratios of less than:

$$\frac{Dext - Dint}{4} \geq e$$

which was beyond the reach of the existing methods.

SUMMARY OF THE INVENTION

In order to meet the above requirements, the process which is the subject of the present invention has been developed, by means of which it is feasible to manufacture yarn bobbin tubes from conventional cardboard tubes, obtaining a given bobbin tube by means of specific devices created expressly for the purpose, thus allowing modes of utilisation of the bobbin tubes obtained according to the invention to be put into practice.

The subject of the invention is a process for the manufacture of a cardboard bobbin tube which can be arranged in vertical lineal succession by means of a light fitting together of a given end of one tube in the opposite end of a second analogous tube, for the purposes of which the following conventional operative phases are first performed:

a.—start with a cardboard tube, of a length suitable for the size of bobbin tube to be obtained, b.—secure said cardboard tube so that it has a cantilevered free end part; and c.—bead said free end part of the cardboard tube to form an interior hollow roll with a substantially toric form, after which, the invention envisages that the cardboard tube, which is provided at its cantilevered end with an interior hollow roll has, firstly, a narrow marginal area thereof, situated in the exterior face of the wall of said cantilevered end opposite said interior hollow roll, applied against a rotatory die that has a concave operative surface, which is defined by a progressive former adopting the negative form of the profile of an entrant perimetric step to be formed in the cardboard tube by constriction of said narrow marginal area, the diameter of the riser thereof being of equal or lesser magnitude than that of the interior diameter of said cardboard tube and, secondly, said cardboard tube has, simultaneously and centrifugally with respect to the straight section of said cardboard tube, a force of enough intensity applied interiorly against said interior hollow roll to flatten the cavity thereof and apply the wall thereof against the interior face of the wall of the cantilevered end of the cardboard tube which is formed by the action of said rotatory die.

A feature of the invention consists in that the intensity of the force applied to the interior roll is suitable in order that the interior face of the wall thereof be pressed against the interior face of the wall of the end of the cantilevered cardboard tube which is formed by the action of said rotatory die.

Another feature of the process according to the invention consists in that the force applied interiorly and centrifugally, against the interior hollow roll of the original cardboard tube, is applied point-by-point in a continuous sequential manner with progressive intensity.

Another feature of the process lies in the fact that the relative movement between the rotatory die and the cantilevered end of the original cardboard tube, is determined by the axial advance and retreat of said rotatory die with respect to the cardboard tube which is maintained immobile, or vice versa, during the phase in which the entrant perimetric step is formed and the interior hollow roll is simultaneously flattened.

For implementation of the above process, the device according to the invention has been developed, which, substantially, consists in a rotatory shaft which has a cantilevered end to which is solidly mounted a cup-shaped die, which, in the interior face of its perimetric wall, has a stepped profile in which diameters increase from the base wall to the die mouth, the diameter of said mouth being slightly greater than the exterior diameter of the cardboard tube provided with the interior roll, whilst in the interior of said cup-shaped die are provided means for exerting pressure so as to apply, centrifugally and radially, a point-by-point force in a continuous sequential manner with progressive intensity.

A feature of the device according to the invention consists in that the interior stepped profile of the rotatory die perimetric wall, corresponds to the negative of an entrant perimetric step which one wishes to obtain in the end marginal area of the cardboard tube provided with the interior roll.

According to a preferred embodiment of the device according to the invention, the means for exerting pressure on the roll of the cardboard tube are constituted by a roller mounted off-centre in a freely rotating manner in the base wall of the rotatory cup-shaped die and arranged so that the distance between its lateral surface and the interior area of lesser diameter of said rotatory die perimetric wall is of a magnitude no greater than double the thickness of the cardboard tube provided with the interior roll.

In accordance with another embodiment of the device according to the invention the means for exerting pressure on the roll of the cardboard tube are constituted by a roller mounted on the cantilever of a radial arm of a concentric shaft which is interior to the rotatory shaft of the cup-shaped die, which rotatory in a manner different to that of the latter.

The invention envisages that the lateral surface of the pressuring roller of the device has a cone frustum shape whose smaller diameter end is orientated towards the exterior of the cup-shaped die, said surface being either smooth or textured (striated, milled, etc.).

The implementation of the process according to the invention by means of any of the devices described, allows a bobbin tube to be obtained having an end area of the tube wall which is formed exteriorly with a slight entrant perimetric step towards the adjacent free edge of said end area and with an interior roll which, being produced by the beading of said wall, is applied to the inner face of said end area of the wall, such that the exterior diameter of the riser part of said slight perimetric entrant step is equal or less than the interior diameter of the cardboard tube.

Another feature of the bobbin tube according to the invention consists in that the bobbin tube interior roll has the inner face of the wall thereof pressed tightly against the interior face of the cardboard tube over the entire part corresponding to the narrow marginal end area which has been constrained.

The bobbin tubes obtained according to the invention allow an advantageous mode of utilisation, according to which the reels of yarn are situated on a supporting surface, borne by the unconstricted end of the bobbin tube and distributed in lines and columns, to form a first layer which is covered with a cardboard positioning sheet provided with apertures in correspondence with the bobbin tubes which protrude through such, after which a second layer of yarn reels is positioned the bobbin tubes thereof coupling with the equivalent tubes of the yarn reels of the lower layer and so on until the required number of layers is obtained.

The mode of utilisation of the invention contemplates that the yarn reels of each layer are solidly joined to the bobbin tubes which thus bear the weight thereof and in turn transmit the entirety of the load to the lower tubes of a same column in which they are coupled.

In any respect, as is conventional, the bobbin tubes remain free of the reel of yarn in two end areas of equivalent width, one of such end areas being that in which the diameter of the tube is constricted.

According to a preferred mode of utilisation of the yarn bobbin tubes, the cardboard positioning sheets have a thickness less than the distance existing between the opposite facing bases of two reels in a same column, in which the bobbin tubes thereof are coupled with respect to each other, and between the lower base of the lower reel and the column supporting surface.

Similarly, according to another mode of utilisation of the yarn bobbin tubes, the cardboard positioning sheets have a thickness equal to or slightly greater than the distance between the bases of two reels of a column in which the bobbin tubes thereof are coupled and between the lower base of the lower reel of the column and the supporting surface of such.

BRIEF DESCRIPTION OF THE DRAWINGS

To facilitate understanding of the preceding ideas, there follows a description of a preferred embodiment of the invention, with reference to the illustrative drawings attached, in which.

DESCRIPTION OF THE PREFERRED EMBODIMENT

Figure 1:
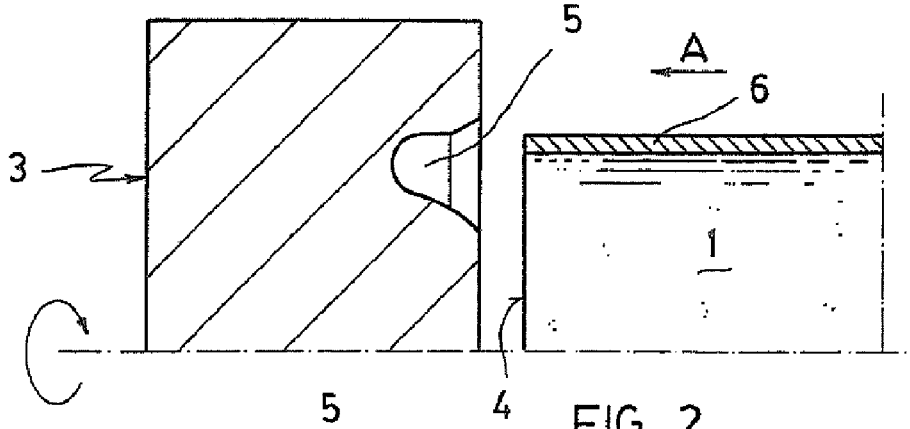
FIG. 1, represents, diagrammatically and in diametric section, half of a conventional rotatory die and a portion of a cardboard tube, such being suitable in order that said rotatory die deform the end edge of the cardboard tube transforming said edge into a conventional interior roll.
Figure 2:
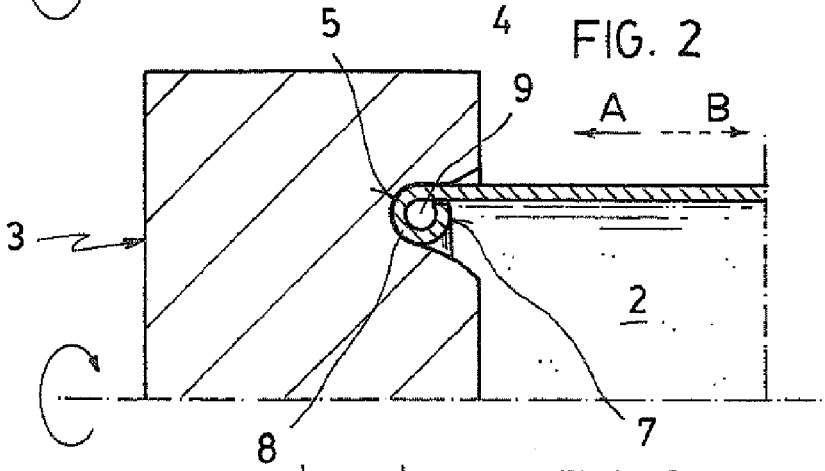
FIG. 2, represents, in a manner analogous to the previous figure, the same components as illustrated in the previous figure once the conventional interior roll has been formed, said roll having an interior cavity which is substantially toric.

FIG. 1 shows the conventional means for transforming an initial cardboard tube 1 into a beaded cardboard tube 2, shown in FIG. 2, which is suitable for carrying out the process according to the invention.

In said FIG. 1 the diametric half of a beading die 3 is shown, being of the conventional rotatory type, also shown is half of a cantilevered end part 4 of said initial cardboard tube 1, said end part 4, which axially faces a profiled annular groove 5 of said beading die 3, is moved in the direction of the arrow A pressing against said profiled annular groove 5, beading the wall 6 of the initial cardboard tube 1 to form an interior roll 7 whose wall 8 envelops a cavity 9 having a substantially toric configuration, thus obtaining the above mentioned beaded cardboard tube 2, as can be observed in FIG. 2.

A relative movement is established between the beading die 3 and the initial cardboard tube 1, according to which the beading die 3, which is rotatory, is maintained axially immobile, whilst said initial cardboard tube 1 is axially mobile in the direction of arrows A and B and immobile in terms of rotation, however it is feasible that, axially, the beading die 3 be movable and that the initial cardboard tube be fixed.

Figure 3:
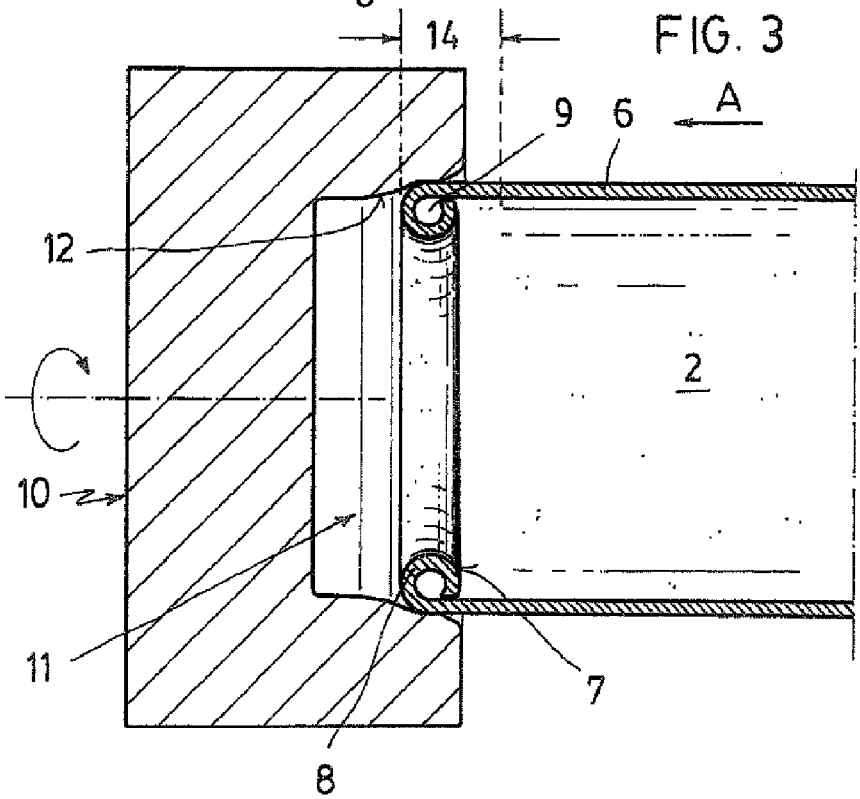
FIG. 3, represents, diagrammatically, the phase of the process according to the invention in which the cardboard tube resulting from the processes of the previous figures such as produced by conventional processes and methods, in which a rotatory die, shown in diametric section, receives the forward edge of the interiorly beaded end of the conventional cardboard tube resulting from FIG. 2.

FIG. 3 shows the phase prior to the commencement of the process according to the invention, and shows a diametric section of a rotatory die 10 which has a concave operative surface 11, which is defined by a progressive former 12 which is profiled to offer the negative of the profile of a entrant perimetric step 13 to be formed in the beaded cardboard tube 2, as can be observed in FIGS. 4, 5, 10 and 11, also shown is a sectioned end part of a beaded cardboard tube 2 inserted into the mouth of the concave operative surface 11 of said rotatory die 10.

Figure 4:
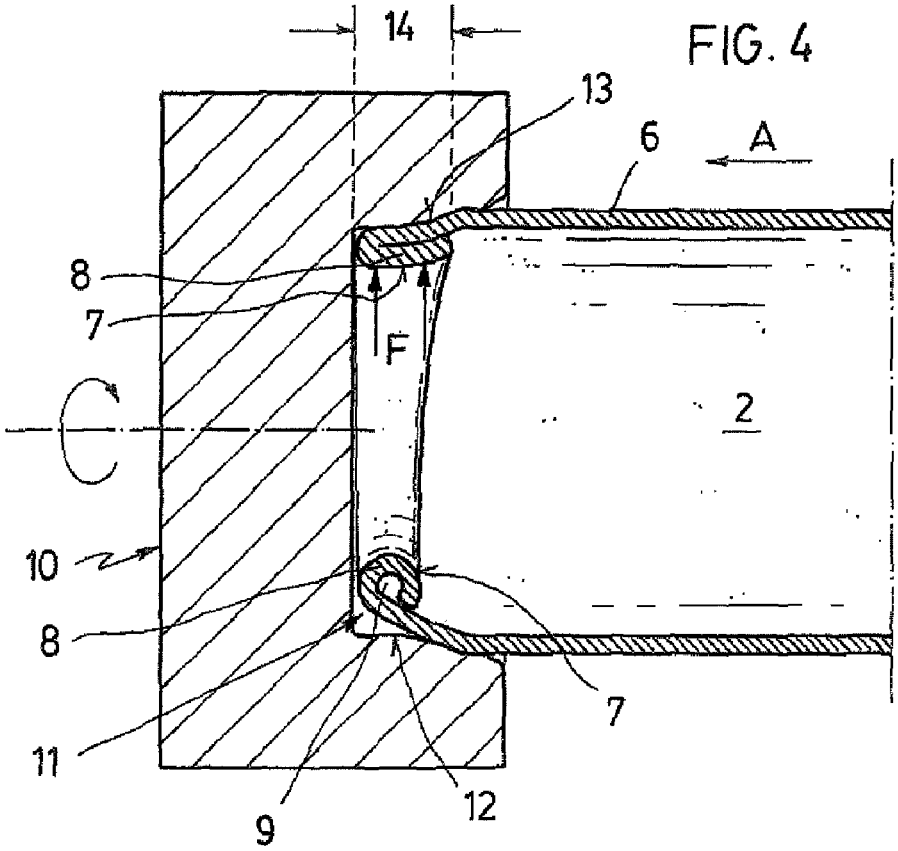
FIG. 4, represents, diagrammatically, the deformation of the interior roll of the cardboard tube of FIG. 3, once said tube has penetrated to the base of the rotatory die and a force is applied centrifugally in a point-by-point manner in order to flatten in a continuous sequential manner the interior hollow roll of the cardboard tube, and to modify the surface of a narrow end area of the cardboard tube forcing it to adopt the form of a entrant perimetric step, with the result that the internal face of the wall of the interior roll is applied against the internal face of said narrow area in which the entrant perimetric step is formed.

The beaded cardboard tube 2 as shown in FIG. 3 in this position is subjected to an axial force in the direction of arrow A, in order to forcibly introduce a narrow end area 14 of said beaded cardboard tube 2, whilst simultaneously, as shown in FIG. 4, a force F is exerted interiorly on the roll 7 with enough intensity to flatten the cavity 9 of said roll 7 and apply the wall 8 thereof against the interior face of the wall 6 of the beaded cardboard tube 2 as to the narrow end area 13 thereof.

Figure 5:
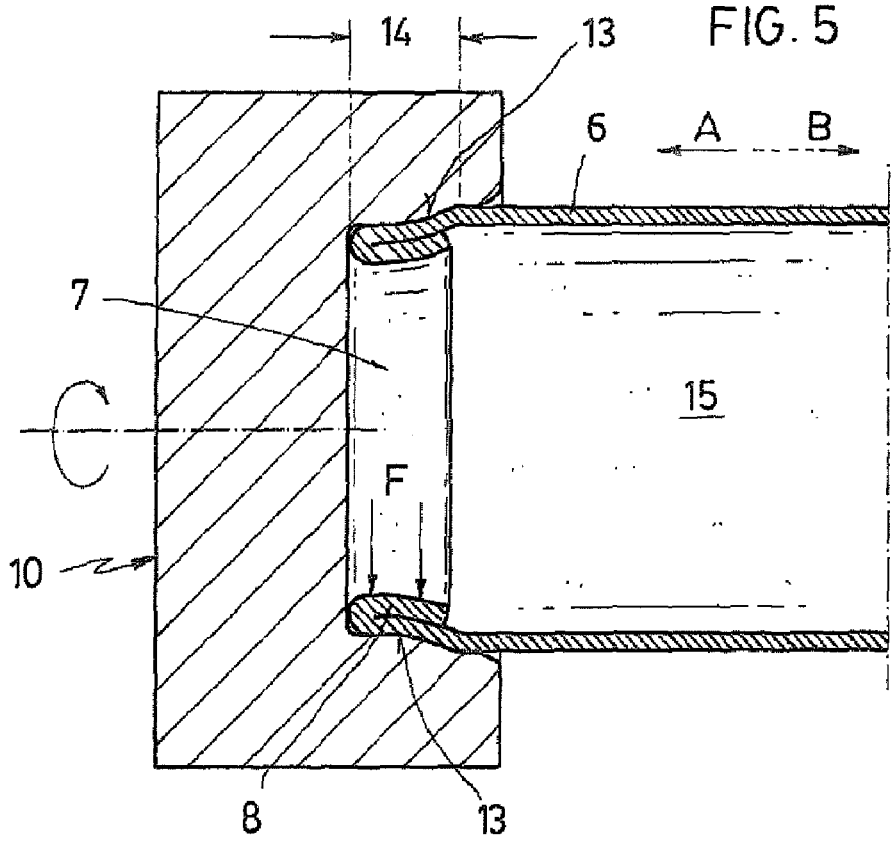
FIG. 5, represents, diagrammatically, the final phase of forming of the entrant perimetric step which configures the constriction of the end of the bobbin tube according to the invention.

This interior force F, directed centrifugally against the roll 7, is of a point-by-point application, as shown in FIG. 4, and is developed in a continual sequential manner with progressive intensity, until having been applied, at least once, to the entire perimeter of the roll 7, such as shown in FIG. 5, thus obtaining the bobbin tube 15, the subject of the present invention, as a result of successive transformations of the initial cardboard tube 1 and of the beaded cardboard tube 2 used in the step prior to the carrying out of the process according to the invention.

Figure 10:
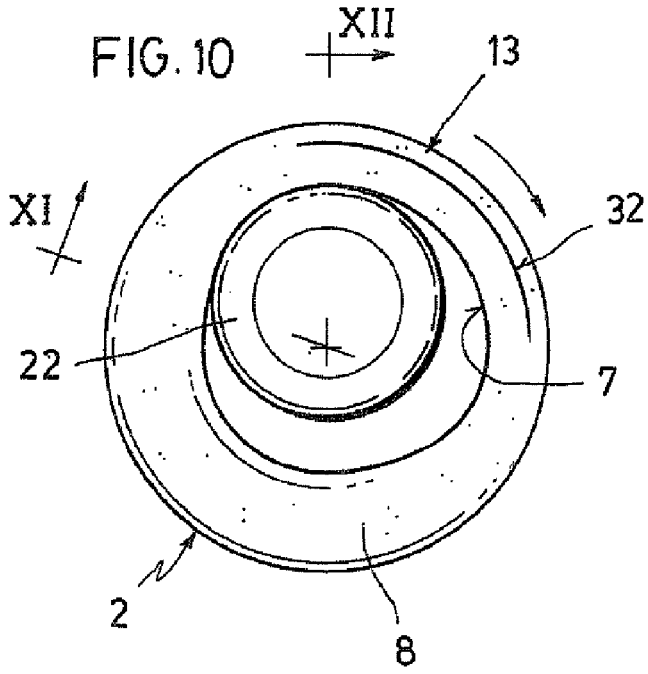
FIG. 10, represents, diagrammatically, the manner in which the device of FIGS. 6 and 7 acts.
Figure 11:
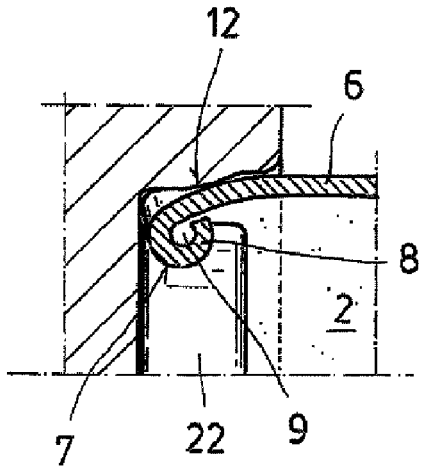
FIG. 11, represents a section through line XI-XI of FIG. 10.
Figure 13:
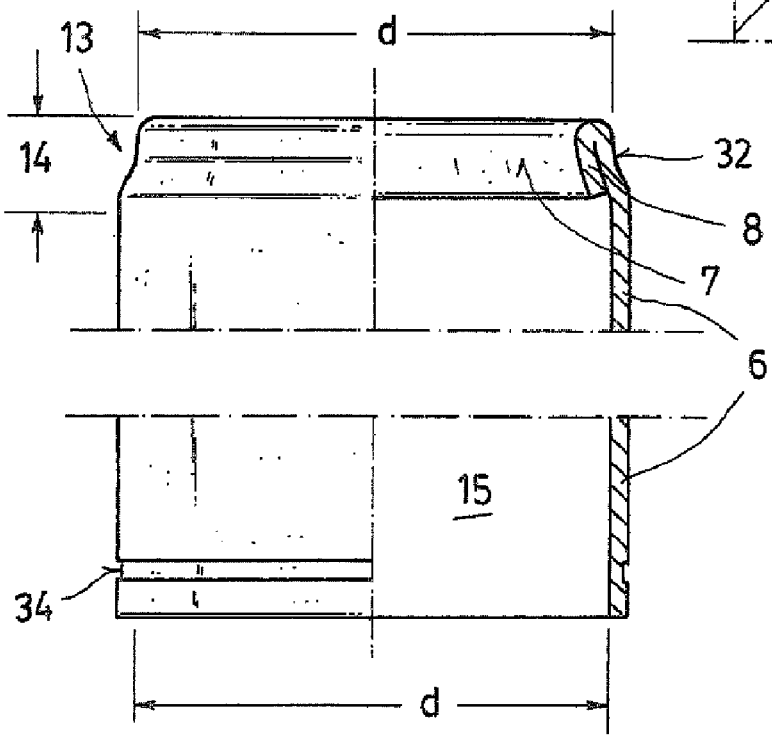
FIG. 13, represents a diametric section of the two ends of the bobbin tube according to the invention.
Figure 14:
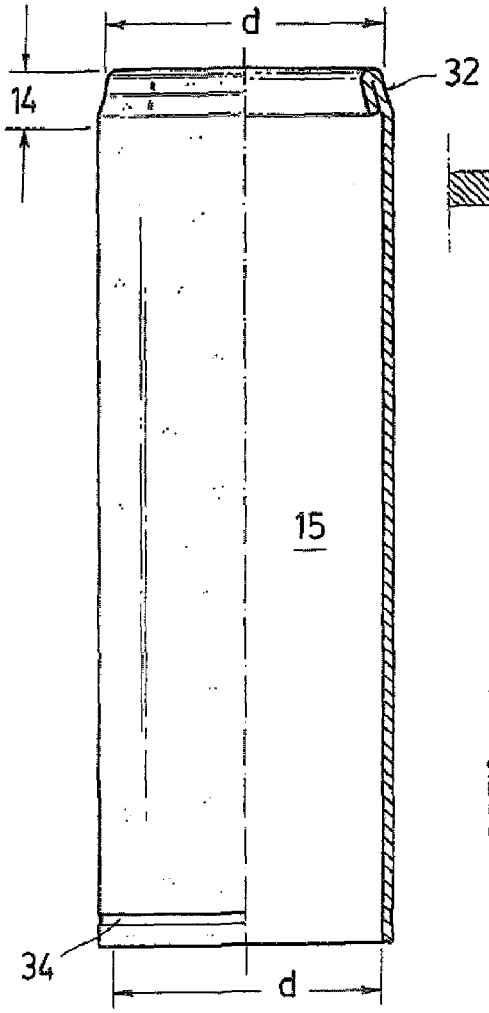
FIG. 14, represents a bobbin tube according to the invention, which is shown in longitudinal section with respect to a diametric half.
Figure 15:
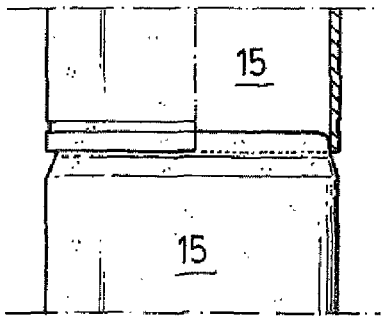
FIG. 15, represents, partially sectioned, the lower end of a first bobbin tube coupled by slight fitting together with the upper end of a second bobbin tube analogous to the first.

One can observe in FIG. 4 that the force F applied point-by-point on an interior roll 7 element, produces the flattening of the wall 8 thereof, reducing or eliminating, as in this case, the cavity 9, said wall 8 thus being entirely abutted against the stretch of wall 6 corresponding to the entrant perimetric step 13 which is created by forming the narrow end area 14 of the beaded cardboard tube 2, whilst the rest of the interior roll 7 is still undeformed, said deformation taking place when the point of application of the force F is moved, which will be in a continual sequential manner with progressive intensity, said intensity being greatest at said point of application, said point being moved progressively and continuously on said interior roll until the shape illustrated in FIG. 5 is obtained, in which the beaded cardboard tube 2 has been transformed, by constriction of the narrow end area 14 to become into the entrant perimetric step 13, in the bobbin tube 15 according to the invention, as shown in FIGS. 10, 11 and 13.

The force F can be applied by any means allowing pressure to be exerted point-by-point on one or more points of a same element of the interior roll 7, as is shown in FIG. 4, as long as it is able to advance on said interior roll 7 and deform it according to a continual sequence and with progressive intensity, which is to say, that it acts with lesser intensity before the point of maximum applied force is reached and reduces said force as said point is distanced, said points of application being separated by an infinitesimal magnitude and being represented by the geometric movement of the element on which the force F acts, the interior roll 7 thus being deformed, the cavity 9 being reduced or eliminated and the entrant perimetric step 13 being formed.

Said force F can be exercised by mechanical means, as is shown in FIGS. 6 to 9 and which will be described below, or by other means such as high pressure fluid, ultrasound, stamping, etc.

In the present invention mechanical means which have been tested with success are preferred, but this does not prejudice investigation into the other means.

Figure 6:
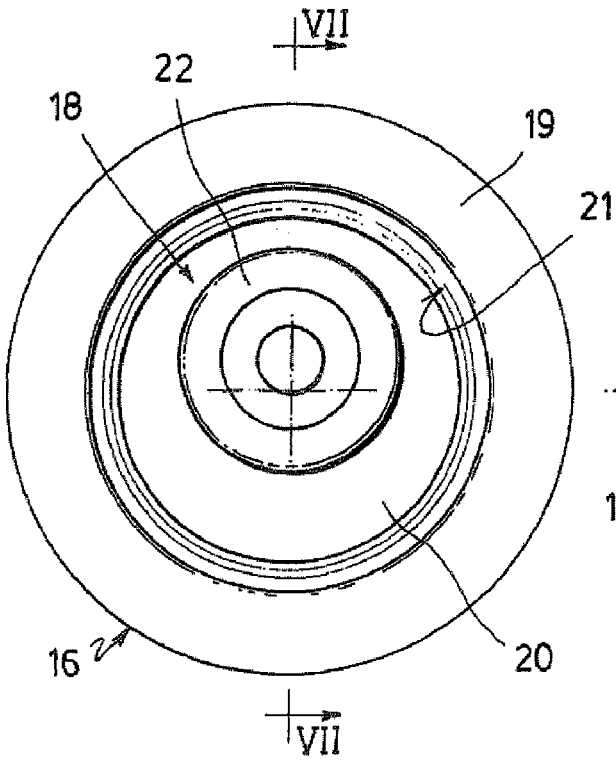
FIG. 6, represents a possible preferable embodiment of a device for carrying out the process according to the invention, in which a cup-shaped rotatory die is shown, viewed from the mouth thereof, having its interior wall profiled and an off-centre roller in proximity to said wall.
Figure 7:
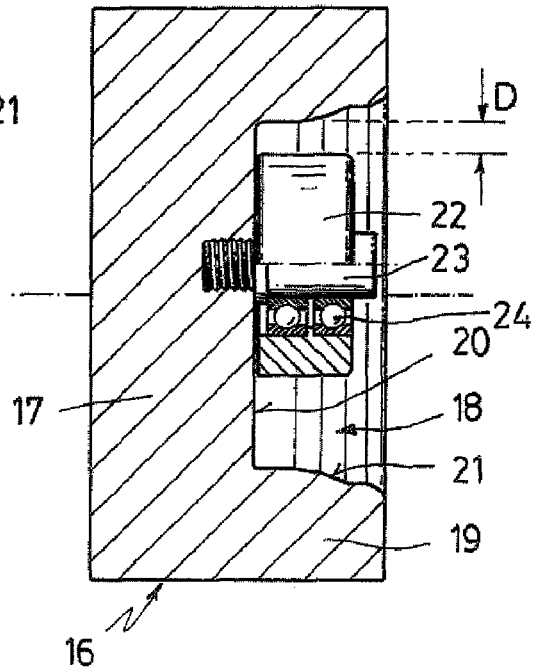
FIG. 7, represents a section through line VII-VII of FIG. 6.

FIGS. 6 and 7, illustrate a cup-shaped rotatory die 16 which is constituted by a cylindrical body 17 having an operative recess 18 which determines a thick wall 19 and a base 20, the interior face of said wall 19 being profiled according to a revolution machining 21 shaping the surface into the negative of the entrant perimetric step 13 to be formed in the narrow end area 14 of the beaded cardboard tube 2, whilst in the base 20 of the operative recess 18 there is a roller 22, mounted at an off-centre point thereof, in a freely rotative manner on a shaft 23 and bearing 24 such that the lesser distance thereof to the wall 19 will be of a magnitude D no greater than twice the thickness of the wall 6 of the beaded cardboard tube 2.

Figure 12:
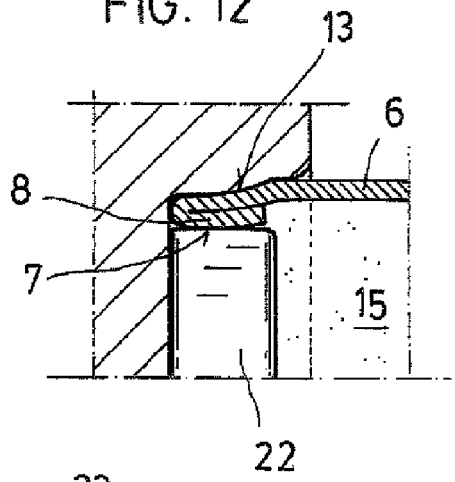
FIG. 12, represents a section through line XII-XII of FIG. 10.

In the case of FIGS. 6 and 7, the roller 22 in calendering the assembly formed by the interior roll 7 and by the wall 6 of the beaded cardboard tube 2 at the narrow end area 14 thereof exerts on such a force F, as illustrated in FIG. 4, a force which decreases with respect to one side and increases with respect to the other as the roller motion advances on the internal roll 7, a roller motion which determines that the force is continual and sequential and in a progressive manner as described above, such as is shown in FIGS. 10, 11 and 12.

Figure 8:
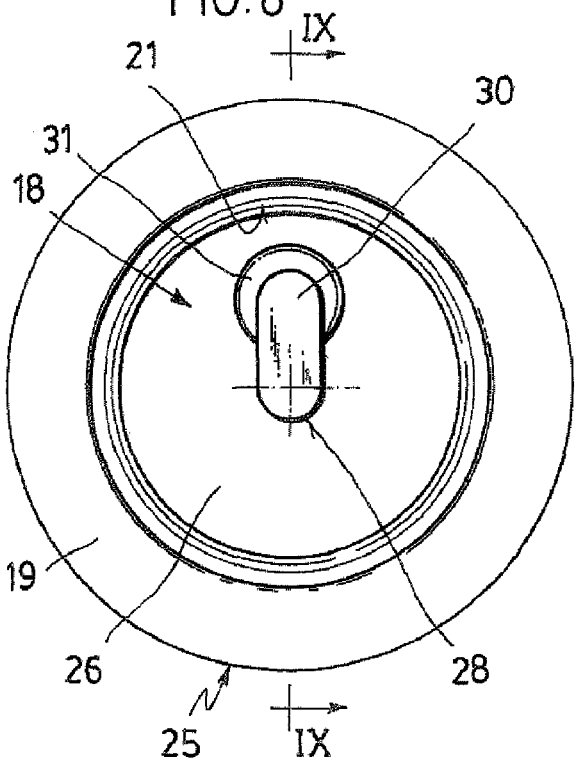
FIG. 8, represents a second possible embodiment of the device for carrying out the process according to the invention, in which a roller is illustrated, also in proximity to the profiled interior wall, which is mounted on a radial arm of a shaft which passes centrally through the rotatory cup-shaped die.
Figure 9:
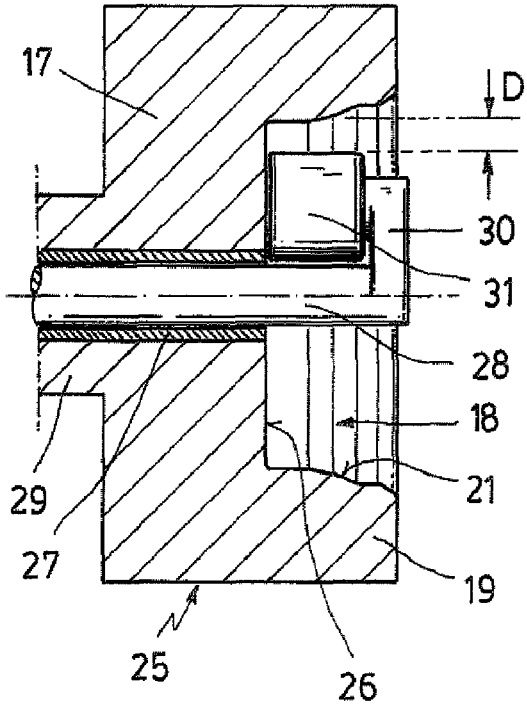
FIG. 9, represents a section through line IX-IX of FIG. 8.

Analogously, the solution adopted in FIGS. 8 and 9 is also suitable. In these figures the cup-shaped die 25 also has an analogous operative recess 18 which determines a thick wall 19 and a base 26, the interior face of said wall 19 being profiled according to the revolution machining 21, as in the previous case of FIGS. 6 and 7, whilst the base 26 has a bearing 27 in its centre which is traversed in a rotatory manner by a shaft 28, concentric with the shaft 29 of the cup-shaped die 25, which has a radial arm 30 mounted on it and, at the cantilevered end of such, a roller 31, which is also distanced by D from the interior face of the wall 19.

In either case, the rollers 22 and 31 have a slightly cone frustum shape, whilst the smaller diameter end of such cone frustum is directed towards the exterior of the operative recess 18, and its lateral surface can be smooth or textured, in the latter case the finishing adopted can be striated, grained, stippled, a distinctive pattern, etc.

The bobbin tube 15 which is the subject of the present invention, such as shown in FIGS. 11 to 15 and 17, is constituted by a cylinder with wall 6 which has one end constrained in the shape of a entrant perimetric step 13 formed to the interior and to which is entirely abutted the interior roll 7, said entrant perimetric step having at its riser 32 a diameter d which is equal to the interior diameter of the other end, thus allowing slight coupling by fitting together, as shown in FIGS. 11, 12, 15 and 17.

The yarn reels 33, in the conventional manner, leave free a narrow end area 14, in which is situated said entrant perimetric step 13, and an equivalent area provided at the other end delimited by a perimetric groove 34.

Figure 16:
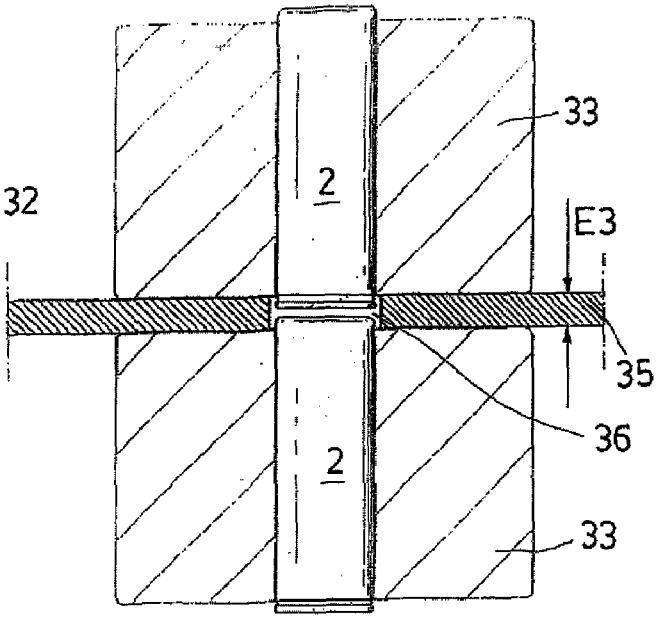
FIG. 16, diagrammatically represents the conventional mode of arranging the reels in columns the yarn being wound around conventional bobbin tubes, lacking means for coupling by being fitted together, and which are seated on thick cardboard sheets serving as separator and positioner.

Ordinarily, the yarn reels 33 wound onto beaded cardboard tubes 2, are arranged for transport and storage in boxes, pallets, containers, etc. so that they form layers, as can be observed in FIG. 16, in which the yarn reels 33 are piled so that their beaded cardboard tubes 2 are aligned but not in contact, being intercalated between the yarn reels 33 on two consecutive layers a thick support sheet 35 made from cardboard and provided with apertures 36 for housing the ends, without entering into mutual contact, of the corresponding beaded cardboard tubes.

Should the bobbin tubes 15 according to the invention be used for winding the yarn, the reels 37 are piled with coupling by means of slight fining together of the bobbin tubes 15 whilst light positioner cardboard sheets 38 or 39 are intercalated, having a thickness E1 less than the separation between two reels 37 or a thickness E2 equal to said separation.

Obviously, in the arrangement adopted in FIG. 16, the weight of the bobbins 33 rests on the thick supporting cardboard sheets 35, which are very thick and heavy, and the beaded cardboard tubes 2 are not able to transmit and support said weight since they remain suspended within the reels 33 and serve only to position the reels 33 with their free ends being introduced in the apertures 36 of said thick cardboard support sheets 35.

These thick cardboard support sheets 35 represent a drawback in package and transport, since they increase the volume and weight of the packaging.

Figure 17:
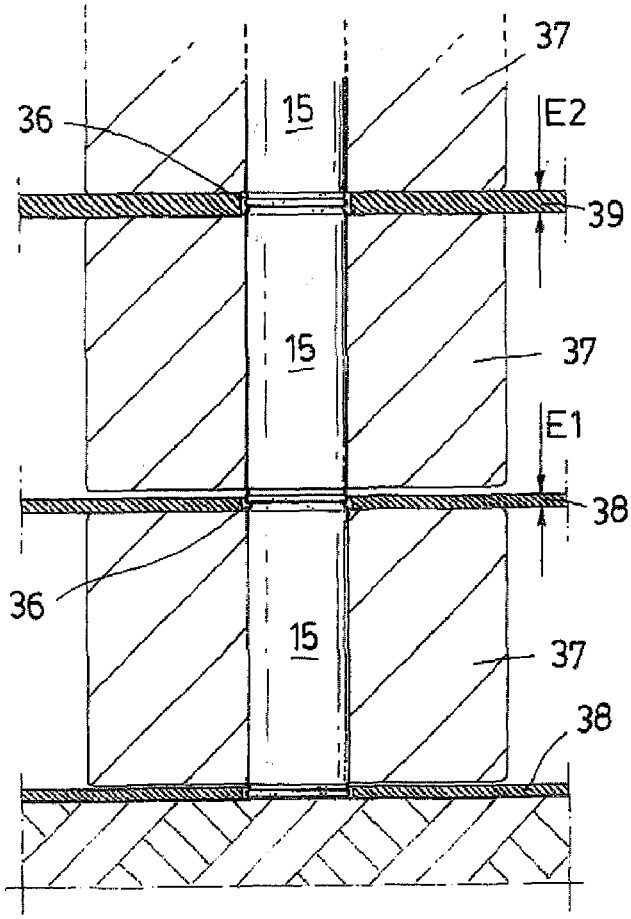
FIG. 17, diagrammatically represents, analogously to the previous figure, the case in which the yarn reels in which said yarn is wound on bobbin tubes according to the invention, are situated in three layers and arranged with two types of positioning sheet.

On the other hand, the bobbin tubes 15 according to the invention allow a mode of utilisation in storage and transport of yarn reels 37 which reduces the volume and weight of packaging, since the bobbin tubes 15, being fitted together vertically, as shown in FIG. 17, and borne on a supporting surface 40, support the entire weight of the yarn reels 37, the thick cardboard support sheets 35 are thus no longer necessary and can be removed, to be substituted by the light cardboard sheets 38 or 39 which are also provided with positioning apertures 36

The basic difference of the invention lies in the combination of a conventional former tool, the rotatory cup-shaped die 16 and 25, which incorporates in the interior thereof a rotatory device, the rollers 22 and 31, which is capable of strongly compressing the cardboard without producing undesirable delamination.

This technology need not be restricted to obtaining the yarn bobbin tubes of the invention, but also offers considerable advantages in all beading, polishing and compacting operations and other similar operations in the manufacture of cardboard tubes.

The invention claimed is:

1. A yarn bobbin tube, which is made of cardboard and has a cylindrical shape, a plurality of said bobbin tubes capable of being fitted together in successive vertical alignment, said tube comprising:

a wall formed in a cylindrical shape having an interior diameter;

an end area formed at one end of said wall shaped with a slight entrant perimetric step having a riser part on an outer surface of said end area, which narrows towards a free end adjacent to said end area;

an interior roll formed by beading of said wall, wherein at least a portion of an interior face of said interior roll is flattened against an interior face of said end area, so that an exterior diameter of the riser part of said slight entrant perimetric step is equal to or less than the interior diameter of said wall.

2. The yarn bobbin tube according to claim 1, wherein the interior face of said interior roll is entirely flattened against the interior face of said end area.

3. The yarn bobbin tube according to claim 1, wherein the exterior diameter of the riser part of said slight entrant perimetric step is equal to the interior diameter of said wall at a second end area of said wall, wherein said second end area is at an opposite end of said tube from said end area.

4. The yarn bobbin tube according to claim 3, wherein a perimetric groove is provided on an outer surface of said second end area of said wall.

* * * * *